United States Patent [19]

Kawano et al.

[11] Patent Number: 4,511,301

[45] Date of Patent: Apr. 16, 1985

[54] CLAMP DEVICE FOR PAPER SHEET BUNDLES IN A PAPER SHEET COUNTING AND BANDSEALING APPARATUS

[75] Inventors: Hikaru Kawano, Odawara; Koji Sato, Hiratsuka; Hiroyoshi Nogi, Tokyo, all of Japan

[73] Assignees: Musashi Co., Ltd., Tokyo; Hitachi Engineering Kabushiki Kaisha, Kanagawa, both of Japan

[21] Appl. No.: 561,562

[22] Filed: Dec. 14, 1983

[30] Foreign Application Priority Data

Dec. 22, 1982 [JP] Japan ..... 57-223924

[51] Int. Cl.[3] ..... B41J 13/10; B65H 31/30

[52] U.S. Cl. ..... 414/43; 271/213; 414/907

[58] Field of Search ..... 271/177, 178, 212, 213, 271/314; 414/43, 103, 907

[56] References Cited

U.S. PATENT DOCUMENTS 3,131,932 5/1964 Maidment ..... 414/907 X
3,139,278 6/1964 Maidment ..... 414/103 X
3,719,266 3/1973 Korn et al. ..... 414/103 X
4,447,167 5/1984 Euteneuer et al. ..... 271/177 X

*Primary Examiner*—Robert J. Spar
*Assistant Examiner*—Janice Krizek
*Attorney, Agent, or Firm*—Brooks Haidt Haffner & Delahunty

[57] ABSTRACT

A clamp device for paper sheets is comprised of a stacker member including a stacker piece and a stacker block and adapted for holding paper sheets whose number has been counted in a stacked state, a concavely curved paper sheet receiving surface formed on a surface of said stacker piece adjacent to and contactable with the paper sheets, a driving member provided to said stacker piece at a position opposite to said stacker piece, a convexly curved pressing surface provided on one end of said driving member and operable in a confronting relation to said curved paper sheet receiving surface, and a barrier plate mounted above said stacker piece for preventing popping out of the paper sheets from the stacker member upon impingement of the sheets onto said stacker block. The paper sheets may be clamped in a bent state by said concavely curved paper sheet receiving surface and said convexly curved pressing surface.

2 Claims, 3 Drawing Figures

CLAMP DEVICE FOR PAPER SHEET BUNDLES IN A PAPER SHEET COUNTING AND BANDSEALING APPARATUS

BACKGROUND OF THE INVENTION

This invention relates to a counting and bandsealing apparatus for paper sheets such as banknotes and, more particularly, to a clamp device for the bundles of paper sheets whose number has been counted.

So far, various transport systems for use with counting and bandsealing apparatus for paper sheets are known in the art. Typical of these are a system in which the paper sheets whose number has been counted are stacked in a stacker unit and transferred to a transfer belt whereby they are further conveyed to the bandsealing section; a system in which the banknotes whose number has been counted are stacked at a stacker and transferred to the bandsealing section as they are clamped between an upper endless belt and a lower endless belt; and a system in which the banknotes whose number has been counted are stacked at a stacker that is opened laterally in the banknote delivery direction and are introduced by a pusher into the bandsealing section. In all of these systems, the banknotes are unstable while being transported and the stack tends to become disordered when introduced into the bandsealing section, thus causing great inconvenience in the transport and bandsealing operations.

SUMMARY OF THE INVENTION

It is therefore an object of the present invention to provide means highly effective to obviate the aforementioned disadvantages of the conventional device. According to the invention, a concavely curved paper sheet receiving surface is formed on a surface of the stacker piece adjacent to and contactable with the paper sheets, and a convexly curved pressing surface driven by a driving member is provided at a position confronting said stacker piece, while a barrier plate is provided for preventing paper sheets from popping out upon impingement on and bouncing from the stacker bottom. The paper sheets are positively clamped at a predetermined position in the curved state by said concavely curved paper receiving surface and said convexly curved pressing surface.

DESCRIPTION OF THE PREFERRED EMBODIMENT

Reference is had to the accompanying drawings for illustrating a preferred embodiment of a curved clamping device for paper sheets according to the present invention.

Figure 1:
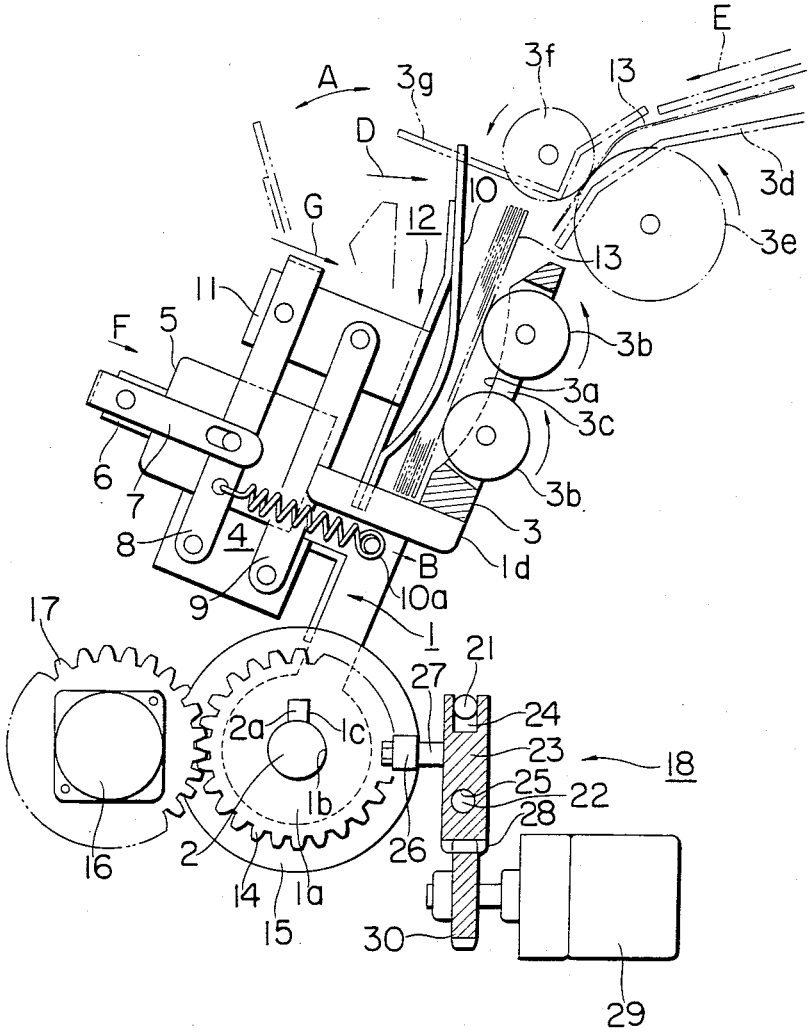
FIG. 1 is a side elevation showing an embodiment of the clamp device of the present invention, the device being shown at the counting and stacking position and shown partly in section.
Figure 2:
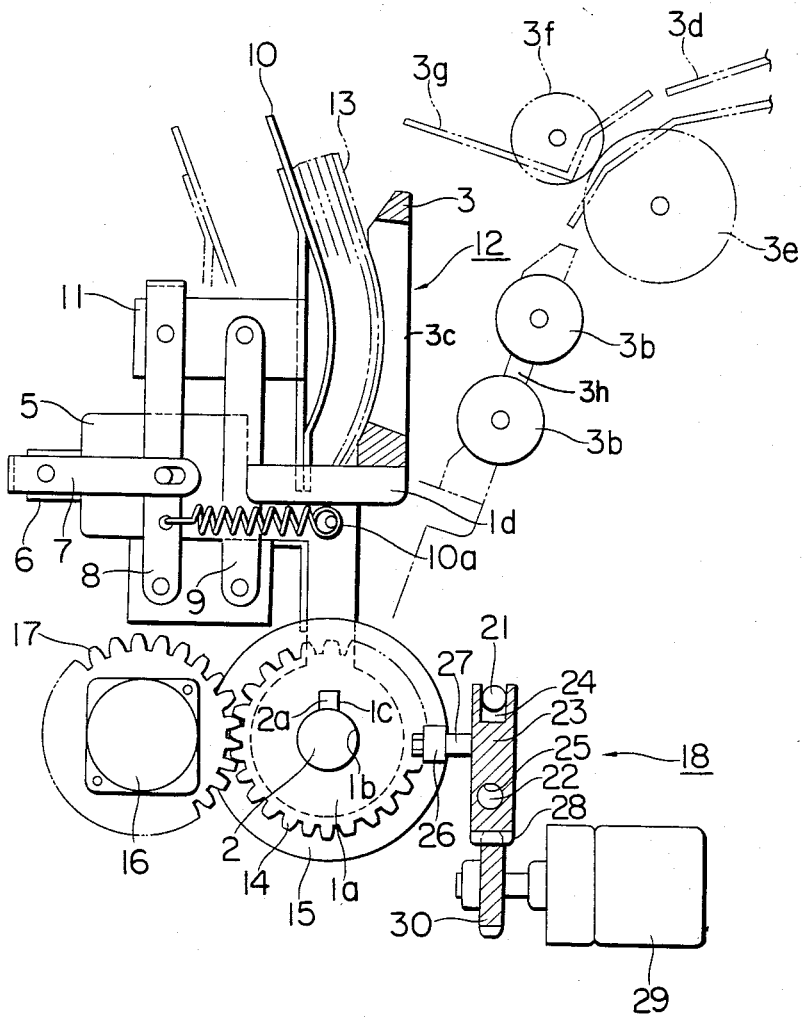
FIG. 2 is a side elevation of the clamp device shown in FIG. 1, the device being shown at the transport position and partly in section.
Figure 3:
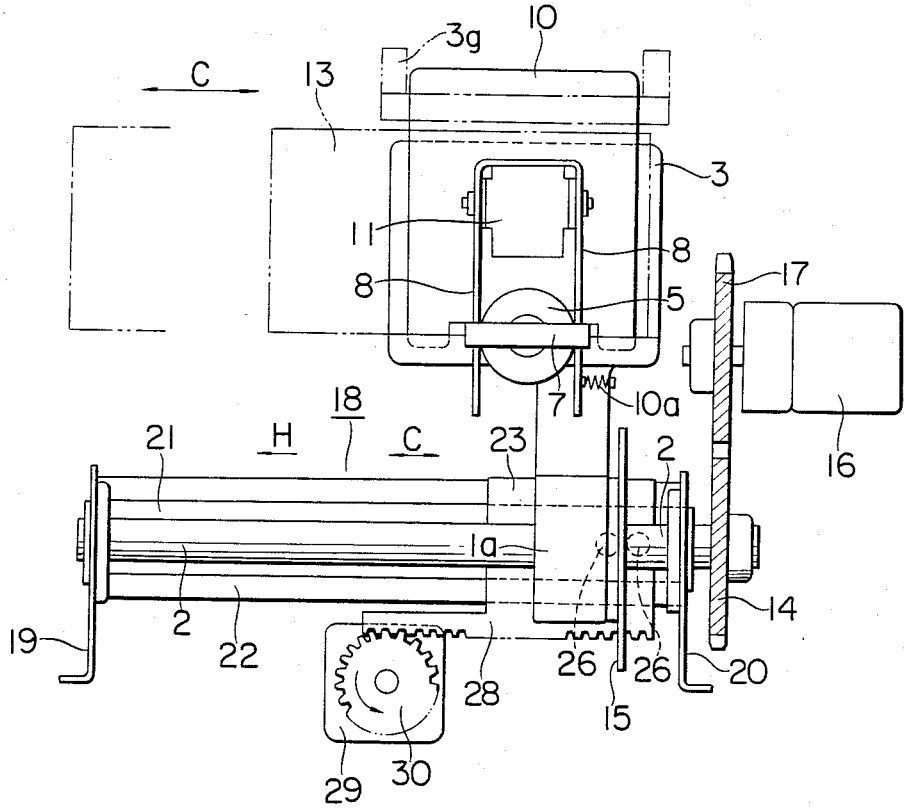
FIG. 3 is a front view of the clamp device of FIG. 1, looking from the left-hand side of FIG. 1.

Referring to FIGS. 1 to 3, the numeral 1 designates a banknote stacker member mounted on a supporting shaft 2, which is loosely fitted in a holding through-hole 1*b* provided in a root 1*a* of the stacker member 1. The shaft 2 has a longitudinal rib 2*a* slidably engaging in a guide recess 1*c* communicating with the holding through-hole. In this manner, the stacker member 1 may be rotated in unison with the supporting shaft 2, while being slidable lengthwise of the shaft 2, by reason of engagement of the rib 2*a* in the guide recess 1*c*.

A stacker piece 3 is mounted substantially upright on a stacker block 1*d* provided at the upper extremity of the banknote stacker 1, and a concave paper sheet receiving surface 3*a* is formed on the inner surface, that is, the surface contacted by the paper sheets, of the stacker piece 3. A solenoid 5 is mounted on a supporting member 4 provided to the lateral side of the stacker member 1. A plunger 6 operatively associated with the solenoid 5 mounts a U-shaped first arm 7 which is pivotally connected to substantially the center of a second arm 8 which in turn is pivotally connected at one end to said supporting member 4. Similarly, a third arm 9 is pivotally connected at one end to the supporting member 4. A presser 11 having a convex paper sheet pressing surface 10 is pivotally and operatively connected to the other ends of the second and third arms 8, 9. The curved pressing surface 10 is biased by a return spring 10*a* in the direction of an arrow mark B through the second arm 8. A banknote stacker 12 is made up of the stacker member 1 and the stacker piece 3, and the banknotes 13, only one stack of which is shown in the drawings, are sandwiched and clamped in the curved state between the stacker piece 3 and the pressing surface 10 in the transfer position (FIG. 2).

A rotary gear 14 is formed integrally with the supporting shaft 2 and a guide disk 15 is also mounted integrally to the root 1*a* of the stacker 1. The gear 14 meshes with a turning gear 17 operatively connected to a turning electric motor 16. Upon actuation of the turning electric motor 16, the stacker member 1 is swung in the direction of the arrow mark A through the medium of the turning gear 17 and the rotary gear 14.

To a main body, not shown, of the counting and bandsealing device, there is mounted a pair of stacker rolls 3*b* on a fixed support 3*h* in the vicinity of the stacker piece 3 in the counting and stacking position (FIG. 1), said stacker rolls 3*b* operating to guide the paper sheets 13 onto the stacker piece 3. When the stacker piece 3 has rotated to the counting and stacking position shown in FIG. 1, a portion of each stacker roll 3*b* is projected via a through-hole 3*c* in the stacker piece 3 and beyond the curved paper sheet receiving surface 3*a*, in such a manner that the paper sheets 13 supplied separately from the inside of a hopper 3*d* by the operation of a feed roll 3*e* and a separating roll 3*f* may be positively delivered onto the stacker piece 3, the sheets 13 then being straight and generally vertically oriented as shown in FIG. 1. Above the stacker piece 3 remaining at the counting and stacking position, there is mounted a substantially U-shaped barrier plate 3*g* operable in such a manner that the paper sheets 13 supplied to the stacker piece 3 and impinging on the bottom surface of the stacker block 1*d* may be prevented from popping to the outside.

A transfer unit 18 acting as means for reciprocating the stacker longitudinally of the supporting shaft 2, that is, in the direction of the arrow mark C, is mounted below the stacker member 1 and has a pair of brackets 19, 20 adapted for supporting the aforementioned supporting shaft 2 and a pair of vertically spaced apart guide bars 21, 22.

A slider 23 is mounted slidably reciprocably on the guide bars 21, 22 in the direction of the double-headed arrow mark C, the guide bar 21 slidably engaging in a recess formed on the upper part of the slider 23 and the guide bar 22 slidably engaging in a sliding through-hole 25 provided to the lower part of the slider 23. A connecting member 27 carrying a pair of guide rolls 26 is projectedly mounted to one lateral surface of the slider 23. These guide rolls 26 are engaged with both sides of the guide disk 15 so that the latter is sandwiched between the guide rolls 26. The lower part of the slider 23 is formed with a rack 28 meshing with a rotary gear 30 of a driving electric motor 29 as a transfer driving source.

In the above construction, the operation of clamping and transporting the paper sheets with the aid of the curved clamping device for the paper sheets according to the present invention is now described. First of all, the turning electric motor 16 is activated so that the stacker member 1 is turned in the direction of the arrow mark D from the double-dotted chain-line position to the solid-line or counting and stacking position (FIG. 1) through the medium of the turning gear 17 and the rotary gear 14. The stacker member 1 is halted at the counting and stacking position. In this state, the banknotes 13, that have passed through a counting step by a banknote counting unit, not shown, are supplied by feed rolls, also not shown, from the direction E onto the stacker rolls **3*b* projecting through the curved paper sheet receiving surface 3*a* of the stacker piece 3. The pressing surface 10 is opened against the return spring 10*a* by the operation of the stacker roll 3*b* so that the sheets are transported safely to their destination and stacked there while being regulated by the barrier plate 3*g* against popping out from the interior of the stacker 12. When the number of the banknotes has reached a predetermined value (usually one hundred), it is sensed by a number senser, not shown, which then issues a corresponding output signal to the solenoid 5. Thus the solenoid is activated by this output signal and the plunger 6 is urged in the direction of the arrow mark F at the same time that the pressing surface 10 is urged in the direction of the arrow mark G through the medium of the arms 7, 8 and 9. Thus the paper sheets 13 stacked in front of the curved paper sheet receiving surface 3*a* of the stacker piece 3 will be sandwiched and clamped between the receiving surface 3*a* and the curved pressing surface 10**.

When the clamped state of the paper sheets has been sensed by a clamp sensor, not shown, the turning electric motor 16 is turned on by a corresponding output signal, and the stacker member 1 is turned from the position shown in FIG. 1 to that shown in FIG. 2 through turning gear 17, rotary gear 14, supporting shaft 2, rib **2*a* and the guide recess 1*c*. As the stacker member 1 has been shifted to a substantially upright position, the operation of the driving electric motor 29 is started. Thus the stacker member 1 is moved in the direction of the arrow mark H in FIG. 3 through the guide disk 15 clamped by the guide rolls 26, at the same time that the slider 23 is moved in the direction of the arrow mark H. The paper sheets 13 may thus be transferred in the clamped state to the bandsealing section, not shown, where they are bandsealed. Upon termination of the bandsealing, the solenoid 5 is turned off so that the clamping state of the curved receiving surface 3*a*** and the curved pressing surface is now cancelled.

From the foregoing it will be apparent that the curved clamp device of the present invention enables the stacked paper sheets to be positively clamped in the bent state by the curved paper sheet receiving surface and the curved pressing surface and inhibited from popping out of the stack by the operation of the barrier plate, and also enables the stacked paper sheets to be supplied in the optimum clamping state to the bandsealing section, when the clamp device is applied to the paper sheet counting and bandsealing device, so that there is no risk that the paper sheets be subjected during transport to eventual creasing, drooping, breakage or loss.

What is claimed is:

1. A clamp device for receiving and stacking paper sheets fed thereto sequentially in edge-to-edge relation, comprising a stacker member including a stacker piece having a laterally projecting stacker block thereon, said stacker block extending substantially transversely with respect to the path of said fed paper sheets for impingement by, and support of the leading edges of said sheets as they are received and stacked in said lateral direction in said stacker member, said stacker piece having a concavely curved paper sheet receiving surface and means defining a through-hole of said surface, said stacker piece being movable between a first position thereof wherein its said surface is substantially adjacent to the path of said fed paper sheets and a second position thereof which is displaced from its said first position in said lateral direction, the curvature of said concavely curved surface being substantially in the direction of feeding of said paper sheets, a roll-holding member in fixed position adjacent to said first position of said stacker piece and carrying a pair of parallel rotatable rolls which project through said through-hole of said stacker piece and are disposed substantially tangent to the path of said fed paper sheets when said stacker piece is in its said first position, said rolls being rotatable in said direction of feeding of said sheets, a driving member mounted for movement toward and away from said stacker piece and having a convexly curved pressing surface corresponding with, and facing said concavely curved stacker piece surface and said rolls when said stacker piece is in its said first position for receiving and stacking said fed paper sheets in substantially straight condition between said pressing surface and said rolls, and means operable upon attaining the desired stack of said paper sheets for urging said driving member toward said stacker piece and for moving said stacker piece from its said first position and away from said rolls to its said second position to clamp said stacked sheets in curved condition between said convexly curved driving member surface and said concavely curved stacker piece surface as said stacker piece is moved to its said second position.

2. A clamp device according to claim 1, which further comprises a barrier plate mounted substantially adjacent to said stacker piece when in its said first position for preventing popping out of said fed paper sheets from said stacker member following their said impingement on said stacker block.

* * * * *

UNITED STATES PATENT AND TRADEMARK OFFICE

CERTIFICATE OF CORRECTION

PATENT NO. : 4,511,301

DATED : April 16, 1985

INVENTOR(S) : HIKARU KAWANO et al

It is certified that error appears in the above-identified patent and that said Letters Patent is hereby corrected as shown below:

On the title page:

[73] Assignees: should read --Musashi Co., Ltd., Tokyo; Hitachi Denshi Engineering Kabushiki Kaisha, Kanagawa, both of Japan--

Signed and Sealed this

*Third* Day of *December 1985*

[SEAL]

*Attest:*

DONALD J. QUIGG

*Attesting Officer*

*Commissioner of Patents and Trademarks*